United States Patent [19]

Schilder

[11] 4,173,116

[45] Nov. 6, 1979

[54] BULKY YARN SPINDLE FOR SPINNING WHEELS

[76] Inventor: Nell Schilder, 171 Grandview Rd., Ottawa, Ontario, Canada, K2H 8B9

[21] Appl. No.: 483,551

[22] Filed: Jun. 27, 1974

[51] Int. Cl.[2] ..... D01H 3/00; D01H 7/04

[52] U.S. Cl. ..... 57/316; 57/129

[58] Field of Search ..... 57/37, 129, 130, 316

[56] References Cited

U.S. PATENT DOCUMENTS

| | | | |
|---|---|---|---|
| 180,387 | 7/1876 | Snapp | 57/37 |
| 2,538,189 | 1/1951 | Caron | 57/37 |
| 3,796,033 | 3/1974 | Oliver | 57/37 |

FOREIGN PATENT DOCUMENTS

| | | | |
|---|---|---|---|
| 893871 | 2/1944 | France | 57/37 |

*Primary Examiner*—John Petrakes

[57] ABSTRACT

Spinning wheels, equipped with spindle for a flyer and bobbin, are provided with a second and detachable spindle which can be fitted into and locked in the outside orifice of the spindle holding the flyer and the bobbin, to allow the spinning of yarn of larger size or irregular size which would otherwise not pass through the orifice of the spindle holding the flyer, thus allowing the spinning of yarn of any size on the same spinning wheel.

2 Claims, 3 Drawing Figures

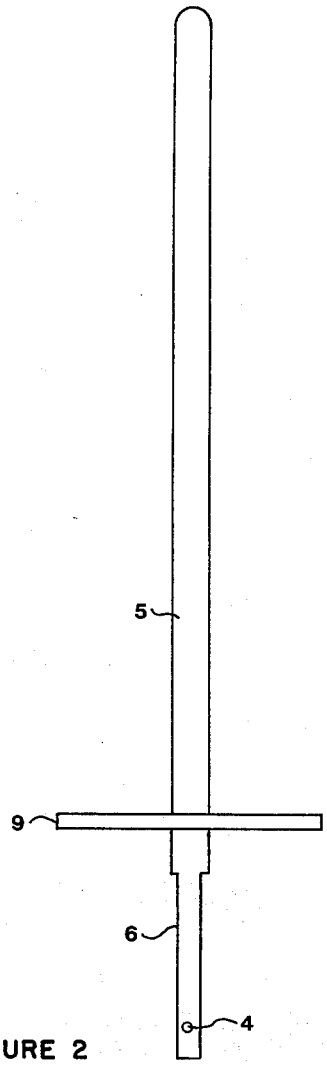
FIGURE 2
FIGURE 1
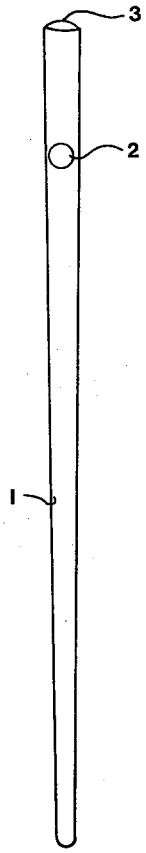
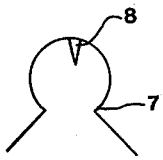
FIGURE 3

BULKY YARN SPINDLE FOR SPINNING WHEELS

BACKGROUND OF THE INVENTION

Various types of spinning wheels exist, each designed to spin a particular yarn. They are either designed to use a spindle with a flyer and bobbin arrangement, which permits spinning of yarn somewhat smaller in thickness than the orifice of the spindle or designed with a spindle onto which the yarn is spun without the use of flyer and bobbin, allowing the spinning of thick and lumpy yarns. In the present art, two different spinning wheels are required to allow the spinning of yarn.

Efforts have been made to overcome the need of two spinning wheels. The spindle head is known, consisting of a driving head, spindle and base on which these are mounted. It requires the removal of the existing bobbin, flyer and spindle in order to be clamped with a C-type clamp onto the saddle of the spinning wheel if the space for clamping is available and subsequently the driving cord has to be fitted over the driving head.

The present invention supplies a detachable spindle which can be easily fitted into the spindle of a wheel with flyer and bobbin without the removal of any parts and can be detached after use in seconds. It allows the spinning of thick and lumpy yarns in addition to fine yarns on the same spinning wheel.

After the wool is tied onto the detachable spindle, the wool is twisted by causing the spindle to rotate by applying the regular treadle mechanism of the spinning wheel and by holding the unspun wool at a slight angle to the spindle. Once a section of wool is sufficiently spun, the yarn is moved sideways at a right angle to the spindle which is kept in rotation to allow the winding of the yarn onto the spindle. The process is repeated time and time again until the spindle is full, at which time the wheel is stopped and the yarn can be taken off.

The object of the present invention is:

To allow spinning of fine, thick and lumpy yarns on the same spinning wheel.

A further object is to supply a detachable spindle for all existing spinning wheels using a flyer and bobbin arrangement eliminating the need for a second wheel.

SUMMARY OF THE INVENTION

In accordance with the present invention a spinning wheel is provided which has, in addition to a spindle with flyer and bobbin, detachable spindle which can be fitted into the outside orifice of the other spindle.

BRIEF DESCRIPION OF THE DRAWINGS

The advantages, the nature of the present invention and its various features will appear more fully upon consideration of the various illustrations now to be described in connection with the accompanying drawings.

In the drawings:

FIG. 1 illustrates a spindle as is commonly used on spinning wheels using a flyer and bobbin and suitable only for spinning of relatively fine yarns;

FIG. 2 illustrates a detachable spindle suitable for spinning of thick and lumpy yarns;

FIG. 3 illustrates a clamp to lock the detachable spindle with the other spindle.

DETAILED DESCRIPTION

Referring to the drawings, FIG. 1 shows a common spindle 1 as is used on spinning wheels using a flyer and bobbin. Spindle 1 allows the spinning of yarns up to the size of orifice 3 through which the yarn is fed.

The yarn comes out of orifice 2 to go over the flyer (not shown) to be wound onto the bobbin (not shown).

The present invention is illustrated by FIG. 2 showing a straight spindle 5, with one end 6 shaped to fit into spindle 1 through orifice 3. The end 6 of spindle 5 is provided with an opening 4 spaced to line up with orifice 2 of spindle 1.

FIG. 3 illustrates a clamp 7 to fit over spindle 1 and has a pin 8 to fit through orifice 2 into opening 4 to anchor spindle 5 onto spindle 1.

Spindle 5 can be provided with a shield 9 to prevent the yarn from going onto spindle 1.

Some spindles on various types of wheels have two orifices similar to orifice 2 but opposite from each other. For those spindles a common bolt and nut can be used to anchor spindle 5. Clamp 7 is preferred as it allows easier detachment of spindle 5.

There is no functional relationship between the detachable spindle and the flyer. Only the existing spindle, to which a flyer is attached, is used as a drive shaft to rotate the detachable spindle. The material is guided to and wound onto the detachable spindle which functions as a bobbin at the same time. Once the detachable spindle is mounted, the existing spindle with flyer and bobbin arrangement cannot be used for spinning but is used only as a drive shaft to rotate the detachable spindle. Once the latter is removed the existing spindle flyer bobbin arrangement are operative instantly.

Spindle 5 thus fits into spindle 1 and is rotated at the same speed as spindle 1, through the regular threading of the spinning wheel as controlled by the foot of the spinner. Spindle 5 fits on the outside of the maidens holding the flyer and bobbin and is not obstructed by any parts, allowing the spinning of yarns of all sizes or with lumps if desired and eliminating the need for a separate spinning wheel, while adding little to the cost of the spinning wheel.

The length and thickness of spindle 5 can vary to suit different requirements.

I claim:

1. A spinning wheel comprising a first spindle for a flyer and a bobbin, said first spindle having a first orifice in its end and a second orifice along its length for guiding yarns to the flyer and the bobbin, a second detachable spindle having an end portion adapted to be fitted into and locked in the first orifice in the first spindle whereby the spinning wheel may alternatively be used to spin yarns using the first spindle with the flyer and bobbin or using the second spindle inserted into the end of the first spindle.

2. A spinning wheel and detachable spindle as claimed in claim 1:

the detachable spindle being equipped with a shield close to but not touching the first spindle to prevent the spun yarn winding onto the first spindle.

* * * * *